United States Patent [19]

Lau

[11] 4,435,495

[45] Mar. 6, 1984

[54] RELEASE OF PHOTOGRAPHIC REAGENTS WITH 3-PYRAZOLIDONE DEVELOPING AGENTS

[75] Inventor: Philip T. S. Lau, Rochester, N.Y.

[73] Assignee: Eastman Kodak Company, Rochester, N.Y.

[21] Appl. No.: 341,713

[22] Filed: Jan. 22, 1982

Related U.S. Application Data

[63] Continuation-in-part of Ser. No. 207,812, Nov. 17, 1980, abandoned.

[51] Int. Cl.[3] ..... G03C 5/54

[52] U.S. Cl. ..... 430/218; 430/219; 430/223

[58] Field of Search ..... 430/223, 218, 219

[56] References Cited

U.S. PATENT DOCUMENTS 4,195,992 4/1980 Stolzenburg et al. ..... 430/223

4,307,175 12/1981 Pollet et al. ..... 430/219

4,310,612 1/1982 Mooberry et al. ..... 430/223

*Primary Examiner*—Mary F. Downey

*Attorney, Agent, or Firm*—Harold E. Cole

[57] ABSTRACT

Photographic reagents can be released, under alkaline conditions, from certain photographic reagent releasing compounds by means of oxidized 3-pyrazolidone developing agents. Particularly useful are acyclic and cyclic compounds in which the photographic reagent is linked, through a hetero atom, to a carbon atom which is adjacent to or in conjugation with a carbonyl group or an imino group. Upon reaction, under alkaline conditions, with an oxidized 3-pyrazolidone developing agent, the bond between the hetero atom and the carbon atom is cleaved. Photographic assemblages containing photographic reagent releasing compounds and processes of releasing photographic reagents in photographic elements and assemblages are described.

21 Claims, No Drawings

RELEASE OF PHOTOGRAPHIC REAGENTS WITH 3-PYRAZOLIDONE DEVELOPING AGENTS

This is a continuation-in-part of U.S. Application Ser. No. 207,812 filed Nov. 17, 1980 now abandoned.

This invention relates to processes for releasing photographic reagents by causing certain photographic reagent releasing compounds to react with an oxidized 3-pyrazolidone developing agent, and to photographic assemblages containing a photographic reagent releasing compound and a 3-pyrazolidone developing agent.

The release of photographic reagent, such as development inhibitor, from a coupler during photographic processing is known. These couplers contain a development inhibitor moiety in the coupling position and have come to be known in the art as "DIR couplers". Development inhibitor is released from a DIR coupler as a consequence of the coupling reaction between the coupler and oxidized color developing agent by which dye is formed. In this reaction the coupler reacts with oxidized color developing agent to form a leuco dye and the development inhibitor is then eliminated from the coupling position. Representative DIR couplers are described for example in such patents as U.S. Pat. Nos. 3,148,062, 3,227,554, 3,617,291, 3,733,201, 3,933,500 and 4,095,984.

In addition to DIR couplers, compounds have been described which react with oxidized color developing agent to form a colorless reaction product and which release a development inhibitor or other photographic reagent. These compounds have been referred to as DIR compounds, to distinguish them from DIR couplers. Representative DIR compounds are described in such patents and published patent applications as U.S. Pat. Nos. 3,632,345, 3,928,041, 3,938,996, 3,958,993, 3,961,959, 4,010,035, 4,029,503, 4,046,574, 4,049,455, 4,052,213, 4,063,950, 4,075,021, 4,121,934, 4,157,916, 4,171,223, 4,186,012 and 4,187,110; U.K. Patent Specifications Nos. 1,445,797, 1,504,094, 1,536,341 and 2,032,914A; German Published patent applications (DT-OS) 2,448,063, 2,552,505, 2,610,546 and 2,617,310; and Belgian Pat. No. 839,083.

Heretofore it had been believed that oxidized color developing agent was required to cause release of development inhibitor, or other photographic reagent, from a DIR compound. While a number of patents have described the use of black and white developing agents with elements containing DIR compounds, the black and white developing agents are described as auxiliary developing agents or are employed in process steps unrelated to release of development inhibitor. The disclosures of these patents show that the patentees believe that a black and white developing agent would not cause release of development inhibitor. Thus, U.S. Pat. No. 4,046,574 in column 7 describes black and white developing agents, including 3-pyrazolidones, as auxiliary developing agents for use with photographic elements in which a development inhibitor is released from a DIR compound upon reaction with oxidized color developing agent. In fact, examples 1 and 7 of U.S. Pat. No. 3,632,345, one of the early DIR compound patents, show that a common black and white developing agent, hydroquinone, does not release development inhibitor from a DIR compound.

Belgian Pat. No. 839,083, in the paragraph bridging pages 5 and 6, summarizes the general understanding of the art regarding DIR couplers and compounds, namely that development inhibitor is released from DIR couplers and compounds by reaction with oxidized color developing agent, and that only with a third group of compounds, those in which development inhibitor is released from a hydroquinone developing agent, is it possible to obtain release without a color developing agent.

The use of oxidized color developing agent to release development inhibitor from DIR compounds is disadvantageous in those photographic materials and processes in which color developing agents are not normally employed. For example, formation of a black and white image in a silver halide element does not normally require a color developing agent. Similarly, there are color materials and processes which do not require color developing agents for formation of a colored image. One such process is employed in forming images by color diffusion transfer with immobile compounds which release a mobile dye. In these materials and processes black and white developing agents, and in particular 3-pyrazolidone developing agents, are used as the sole or principal developing agent. Not only is the color developing agent an additional, otherwise unnecessary, component of the material or processing composition, but in some instances it could cause stain in the processed material.

Thus, there exists a need for a way to release a development inhibitor, or other photographic reagents, during photographic processing in the absence of color developing agents.

I have surprisingly found that development inhibitors and other photographic reagents can be released from certain photographic reagent releasing compounds by means of oxidized 3-pyrazolidone developing agents. This is unexpected since 3-pyrazolidones are understood to be black and white developing agents, not color developing agents. Thus, in accordance with my discovery, a coupling reaction is not required to release development inhibitor, or other photographic reagents, from photographic reagent releasing compounds in accordance with this invention. Rather, photographic reagents can be released by direct oxidation of photographic reagent releasing compounds of this invention by oxidized 3-pyrazolidone developing agent. It is believed that release involves a direct cleavage reaction similar to that described by Trost and Massiot on pages 4407-8 of JACS, 99, 4403-12 (1977).

In one aspect this invention relates to a process of releasing a photographic reagent from a photographic reagent releasing compound by causing the compound to react, under alkaline conditions, with oxidized 3-pyrazolidone developing agent.

In another aspect this invention relates to a photographic assemblage adapted for production of a dye image and release of photographic reagent by means of an oxidized 3-pyrazolidone developing agent under alkaline conditions, the assemblage comprising (a) a support bearing a silver halide emulsion having associated therewith a dye image providing material which provides an imagewise pattern of diffusible dye as a function of silver halide development; (b) a photographic reagent releasing compound comprising an acylic or cyclic compound in which the photographic reagent is linked, through a hetero atom, to a carbon atom which is adjacent to or in conjugation with a carbonyl group or an imino group; (c) a dye image receiving layer; (d) an alkaline processing composition and means for discharging same within the assemblage;

and (e) a 3-pyrazolidone developing agent which in its oxidized form is capable of oxidizing, under alkaline conditions, the photographic reagent releasing compound to cleave the hetero atom from the carbon atom to which it is linked and thereby release the photographic reagent.

As used herein the term photographic reagent releasing compound (occasionally referred to hereinafter by the acronym PRR compound) defines a compound which, upon reaction with an oxidized 3-pyrazolidone developing agent, will release a photographic reagent and form a colorless, or transiently colored, reaction product. The photographic reagent releasing compounds will also form a colorless or transiently colored reaction product upon reaction with oxidized color developing agent. Particularly useful PRR compounds are α-substituted ketones or imines in which a photographic reagent is joined to the α-carbon atom, i.e. a carbon atom adjacent the keto or imino group. In other useful PRR compounds the photographic reagent is joined to a carbon atom which is in conjugation with the keto or imino group through an unsaturated chain of carbon atoms or carbon and nitrogen atoms. In both cases, the photographic reagent is linked to the carbon atom via a hetero atom (e.g. S, N, O, Se) which forms a part of the photographic reagent or a part of a timing group which links the photographic reagent to the remainder of the compound. Oxidation of the PRR compound by an oxidized 3-pyrazolidone developing agent leads to cleavage of the hetero atom from the carbon atom and thereby releases the photographic reagent.

The photographic reagent released in accordance with this invention is preferably a development inhibitor (e.g. mercaptotetrazoles, selenotetrazoles, mercaptobenzothiazoles, mercaptobenzoxazoles, mercaptobenzimidazoles, benzotriazoles, benzodiazoles, etc.), although it can be any reagent which is usefully released in a photographic element during processing to interact with other components of the element, such as a bleach inhibitor (e.g. moderately ballasted mercaptotetrazoles, mercaptobenzimidazoles, mercaptoquinolines, mercaptodiazoles, mercaptothiadiazoles, mercaptothiatriazoles, etc.), a silver halide solvent or complexing agents (e.g. triazenethiones, thiazolinethiones, etc.), a fogging or nucleating agent (e.g. hydrazines, hydrazides, etc.), or an auxiliary developing agent (e.g. hydroquinones). Such photographic reagents contain a hetero atom which can serve as the point of attachment to the carbon atom. Alternatively, the photographic reagent can be joined to the carbon atom via a timing group from which it is displaced following release from the PRR compound.

Suitable photographic reagent releasing compounds useful in this invention are known in the art and are described in the patents and published patent applications cited above in connection with the discussion of DIR compounds. In addition, other suitable photographic reagent releasing compounds in which the photographic reagent is linked to the carbon atom via a timing group are described in my U.S. patent application Ser. No. 972,614 filed Dec. 22, 1978.

Included among the photographic reagent releasing compounds useful in the present invention are those represented by the following structures:

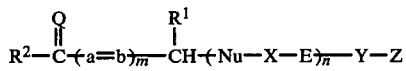

I.

-continued and

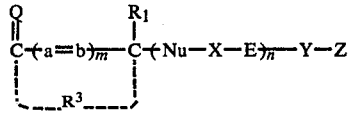

II.

wherein:

Q is oxo (=O) or imino (=NR$^4$), where R$^4$ is hydroxy or amino;

Y is sulfur (—S—), oxygen (—O—) or amino

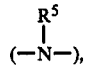

where R$^5$ is hydrogen, alkyl, aryl or a covalent bond in a heterocyclic ring formed by Y and Z;

Z represents the atoms which, together with Y, form a photographic reagent;

m is 0 or 1;

n is 0 or 1;

one of a and b is

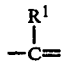

and the other is

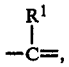

or —N—;

Nu—X—E is a timing group which, upon displacement from the carbon atom to which it is attached, undergoes an intramolecular nucleophilic displacement reaction to release Y—Z, where Nu is a nucleophilic group, E is an electrophilic group and X is a linking group for spatially relating Nu and E, upon displacement from the carbon atom to undergo an intramolecular nucleophilic displacement reaction;

R$^1$ is hydrogen, halogen, alkyl, aryl, heterocyclyl, —Nu—X—E)$_n$Y—Z or O—R$^6$, where R$^6$ is alkyl, aryl, heterocyclyl, acyl

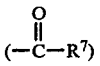

or sulfonyl (—SO$^2$R$^7$), where R$^7$ is alkyl, aryl or heterocyclyl;

R$^2$ is alkyl, aryl, heterocyclyl, cyano, amino (—N(R$^8$)$_2$), sulfonyl (—SO$_2$R$^8$), sulfo (—SO$_2$OR$^8$), sulfonamido (—SO$_2$N(R$^8$)$_2$), onium (—N$^+$(R$^8$)$_3$) or OR$^8$, where R$^8$ is hydrogen, alkyl, aryl or heterocyclyl, or two R$^8$ groups can combine with a nitrogen atom to which they are attached to form a heterocyclic nitrogen ring; and R$^3$ represents the atoms to complete a saturated or unsaturated, carbocyclic or heterocyclic ring or ring system containing at least one 5- to 7-membered ring.

The alkyl groups represented by R$^1$, R$^2$, R$^5$, R$^6$, R$^7$ and R$^8$ can be selected from unsubstituted or substituted, straight chain, branched chain or cyclic alkyl groups containing a total of 1 to 30 carbon atoms. Useful substituents include one or more of the following groups: hydroxy, halogen, nitro, cyano, thiocyano, alkoxy, aryl, aryloxy, amino, carboxy, acyl, alkoxycarbonyl, aryloxycarbonyl, carbamoyl, acylamino, sulfo, alkylsulfonyl, arylsulfonyl, alkoxysulfonyl, aryloxysulfonyl, sulfamoyl, sulfonamido and heterocyclyl.

The aryl groups represented by $R^1$, $R^2$, $R^5$, $R^6$, $R^7$ and $R^8$ can be selected from unsubstituted or substituted aryl groups containing a total of 6 to 30 carbon atoms. Useful substituents include one or more of the following groups: hydroxy, halogen, nitro, cyano, thiocyano, alkyl, alkoxy, aryloxy, amino, carboxy, acyl alkoxycarbonyl, aryloxycarbonyl, carbamoyl, acylamino, sulfo, alkylsulfonyl, arylsulfonyl, alkoxysulfonyl, aryloxysulfonyl, sulfamoyl, sulfonamido and heterocyclyl.

The heterocyclyl groups represented by $R^1$, $R^2$, $R^6$, $R^7$ and $R^8$ can be selected from heterocyclic rings and ring systems containing such hetero atoms as nitrogen, oxygen, sulfur and selenium comprising at least one 5- to 7-membered heterocyclic ring. The ring system can contain fused aryl rings and can be unsubstituted or substituted with groups described above as suitable substituents for alkyl and aryl groups.

The carbocyclic and heterocyclic rings and ring systems completed by $R^3$ comprise at least one 5- to 7-membered ring containing carbon, nitrogen, oxygen, sulfur and/or selenium atoms. At least one of the rings is a cyclic ketone, or an imine analog thereof. Representative rings and ring systems include cyclopentanone, cyclopentanonimine, cyclohexanone, cyclohexadione, cyclohexenone, piperidone, lactone, pyrrolidone, hydantoin, indanone, indanonimine, benzocyclohexanone, benzocycloheptone oxyindole and oxazolinone. The rings can be unsubstituted or substituted with groups described above as suitable substituents for alkyl and aryl groups.

The amino groups represented by $R^4$ can be unsubstituted or substituted with such groups as alkyl, aryl, alkylcarbonyl, arylcarbonyl and aminocarbonyl.

The photographic reagent represented by Y—Z can be any group which is desirably released in a photographic element in an imagewise fashion to interact with other components of the element, such as a development inhibitor, a bleach inhibitor, a silver halide solvent or a complexing agent, a fogging or nucleating agent, or developing agent. Representative photographic reagents are described above.

The timing group represented by Nu—X—E is described in more detail in my U.S. application Ser. No. 972,614 filed December 12, 1978, the disclosure of which is incorporated herein by reference. The nucleophilic group, Nu, contains an electron rich oxygen, sulfur or nitrogen atom. The electrophilic group, E, contains an electron deficient carbonyl, thiocarbonyl, phosphinyl or thiophosphinyl moiety. The linking group, X, is a divalent aliphatic, aromatic or heterocyclic group which provides favorable spatial relationship for nucleophilic attack of the nucleophilic center in Nu on the electrophilic center in E. With compounds containing such a timing group oxidation of the PRR compound leads to cleavage of the bond between the timing group and the carbon atom and thereafter an intramolecular nucleophilic displacement reaction within the timing group leads to release of the photographic reagent from the timing group. For further details and representative timing groups reference is made to the above-mentioned U.S. Ser. No. 972,614.

Preferred photographic reagent releasing compounds useful in this invention are represented by the structural formulae:

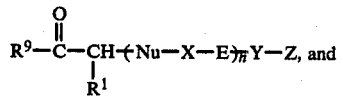

III

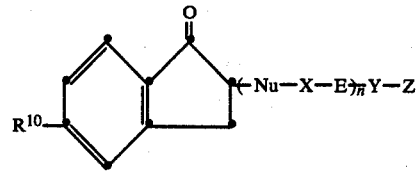

IV wherein:

n, Nu—X—E, Y—Z and $R^1$ are as defined above;

$R^9$ is alkyl, aryl or heterocyclyl, as defined above; and $R^{10}$ is $R^9$, sulfamoyl $(R^{11})_2NSO_2$—), sulfonamido $(R^{11}SO_2NR^{11})$—, carbamoyl $((R^{11})_2NCO$—), or acylamino $(R^{11}CONR^{11}$—) where $R^{11}$ is hydrogen, alkyl, aryl or heterocyclyl as defined above.

Particularly preferred are compounds of structures III and IV wherein:

n is 0;

Y—Z is a development inhibitor;

$R^1$ is hydrogen;

$R^9$ is aryl, especially substituted phenyl such as sulfamoylphenyl and alkoxyphenyl; and $R^{10}$ is sulfamoyl, sulfonamido, carbamoyl or acylamino.

Exemplary photographic reagent releasing compounds are shown below:

Part I - Compounds Which Release A Development Inhibitor Fragment

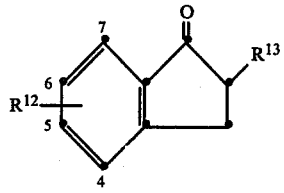

Compound No. $R^{12}$ $R^{13}$

-continued
| | | |
|---|---|---|
| 1 | 6-$NHSO_2C_{16}H_{33}$—n | 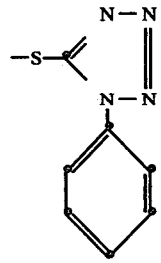 |
| 2 | 6-$SO_2NHC_{18}H_{37}$—n | 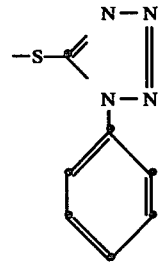 |
| 3 | 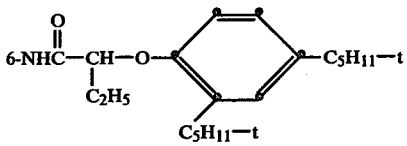 | 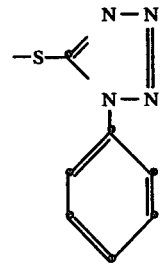 |
| 4 | 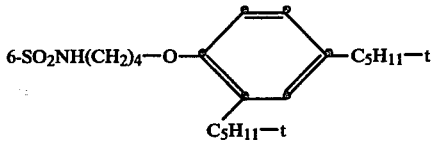 | 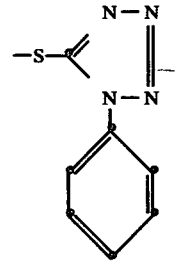 |
| 5 | 6-$NHSO_2C_{16}H_{33}$—n | 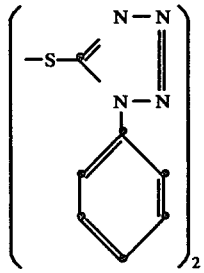 |
| 6 | 6-$NHSO_2C_{16}H_{33}$—n | 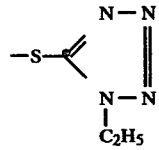 |

-continued
| | | |
|---|---|---|
| 7 | 6-$NHSO_2C_{16}H_{33}$—n | 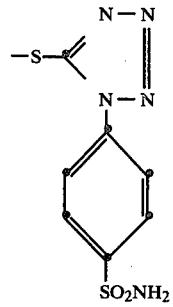 |
| 8 | 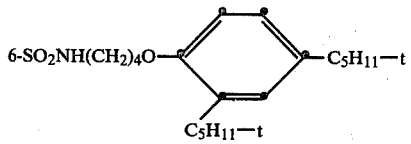 | 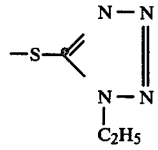 |
| 9 | 6-$NHSO_2C_{16}H_{33}$—n | 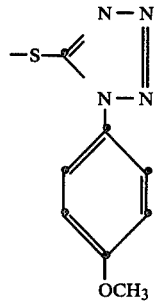 |
| 10 | 6-$NHSO_2C_{16}H_{33}$—n | 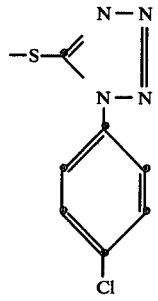 |
| 11 | 6-$NHSO_2C_{16}H_{33}$—n | 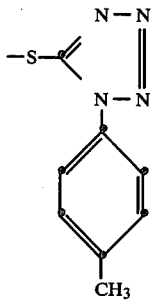 |
| 12 | 6-$NHSO_2C_{16}H_{33}$—n | 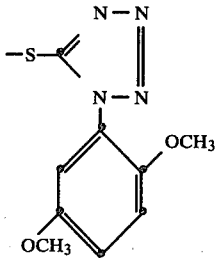 |

-continued
13 6-$SO_2NHC_{18}H_{37}$—n
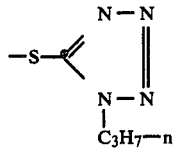
14 4-$NHSO_2C_{16}H_{33}$—n
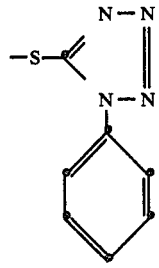
15
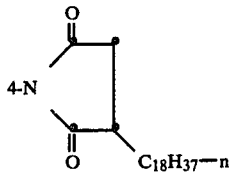
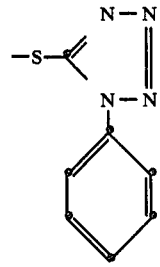
16 6-$NHSO_2C_{16}H_{33}$—n
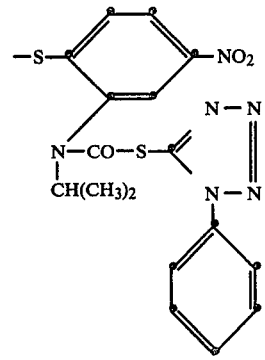
17
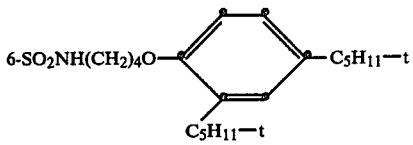
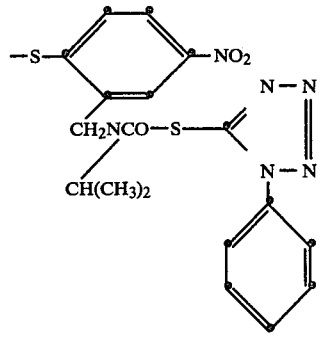
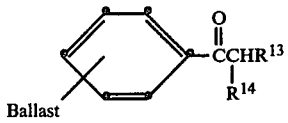
| Compound No. | Ballast | $R^{13}$ | $R^{14}$ |
|---|---|---|---|

-continued
| | | | |
|---|---|---|---|
| 18 | para-$NHSO_2C_{16}H_{33}$—n | 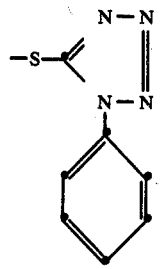 | H |
| 19 | meta-$NHSO_2C_{16}H_{33}$—n | 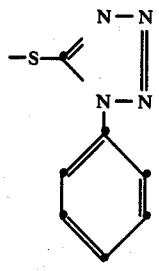 | H |
| 20 | para-$OC_{18}H_{37}$—n | 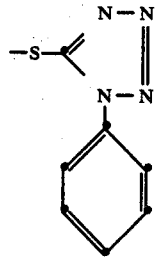 | 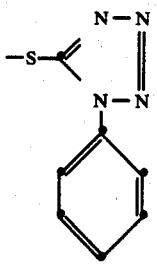 |
| 21 | para-$OC_{18}H_{37}$—n | 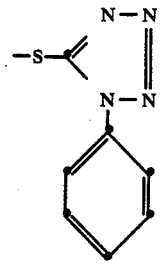 | H |
| 22 | meta-$OC_{18}H_{37}$—n | 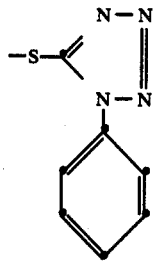 | H |
| 23 | para-$OC_{12}H_{25}$—n | 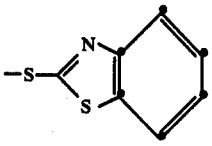 | H |

-continued
| | | | |
|---|---|---|---|
| 24 | para-$OC_{12}H_{25}$—n | 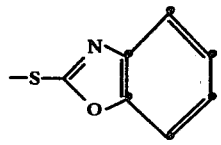 | H |
| 25 | meta-$NHSO_2C_{16}H_{33}$—n | 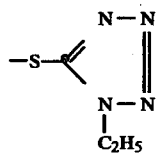 | H |
Part II - Compounds Which Release A Bleach Inhibitor Fragment
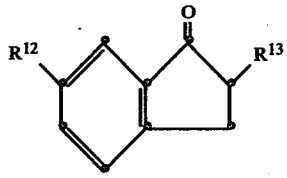
| Compound No. | $R^{12}$ | $R^{13}$ |
|---|---|---|
| 26 | 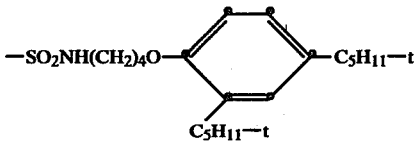 | 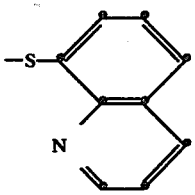 |
| 27 | 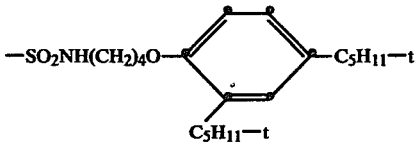 | 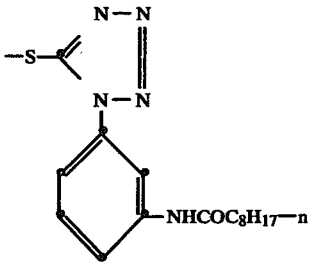 |
| 28 | 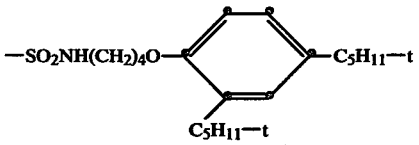 | 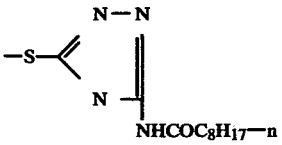 |
Additional photographic reagent releasing compounds useful in this invention are shown below.
29
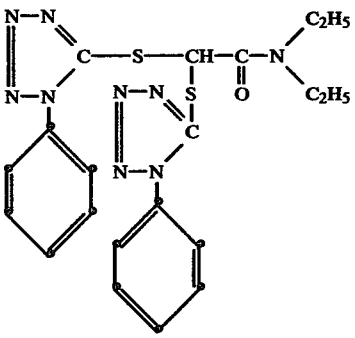
30
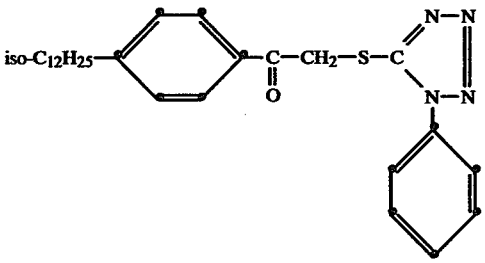

-continued
31
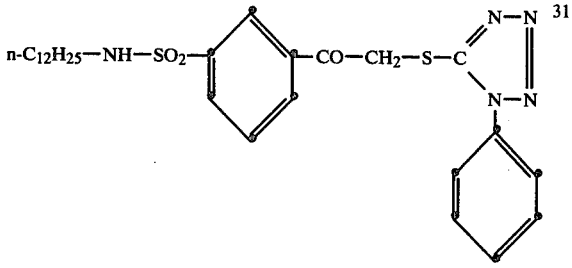
32
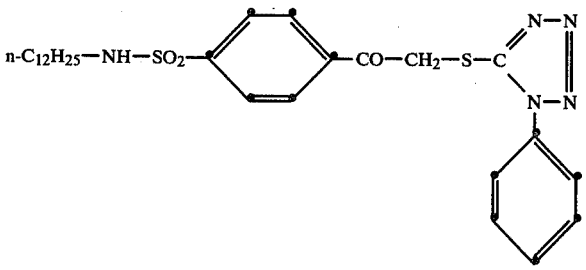
33
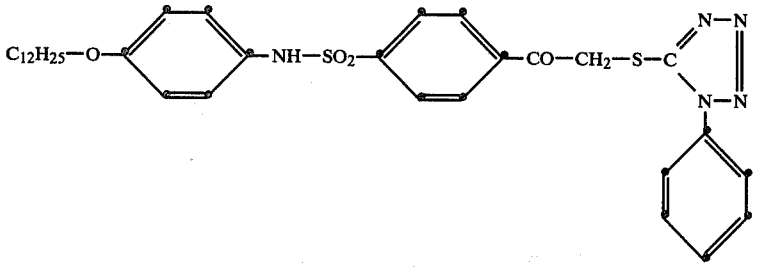
34
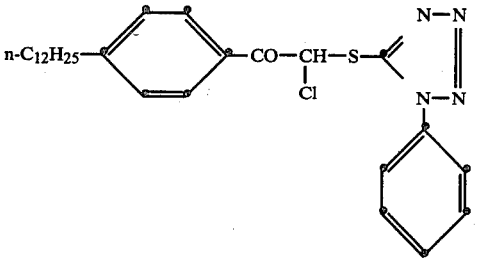
35
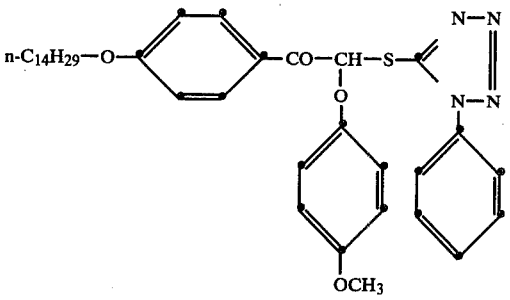
36
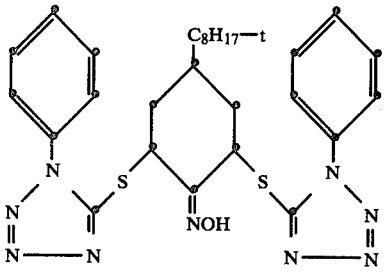
37
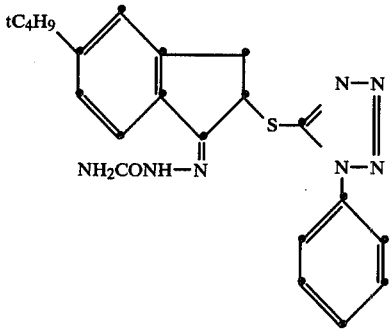
38
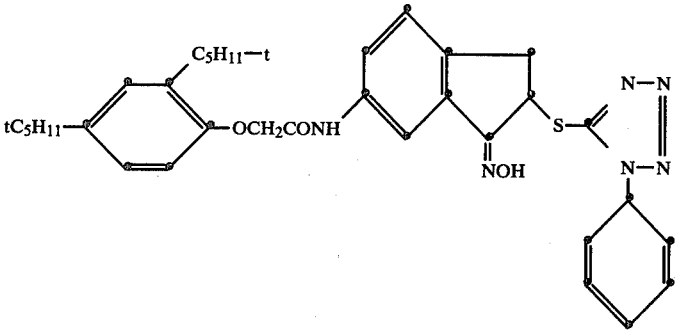

-continued
39
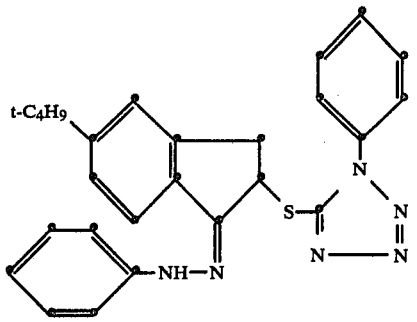
40
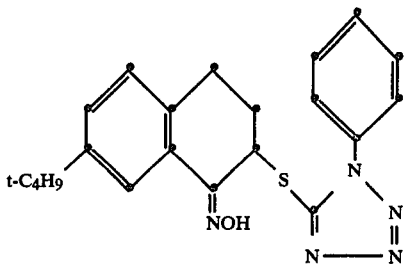
41
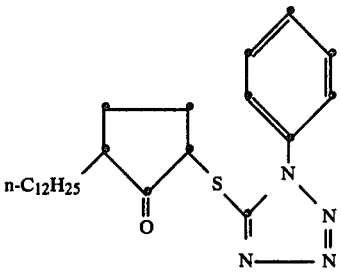
42
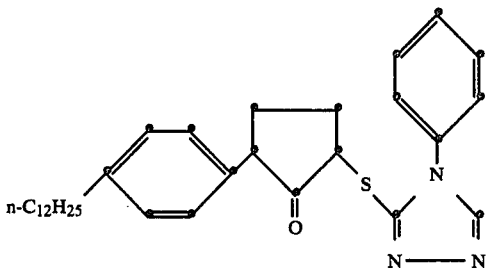
43
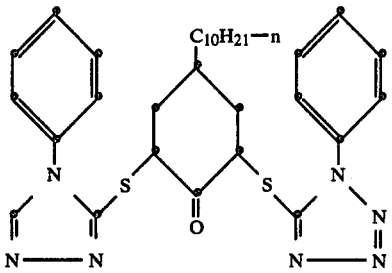
44
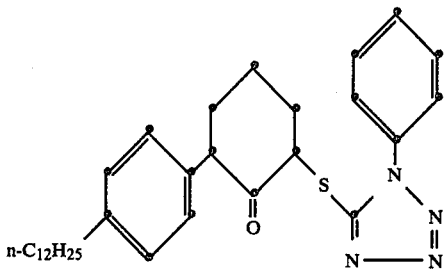
45
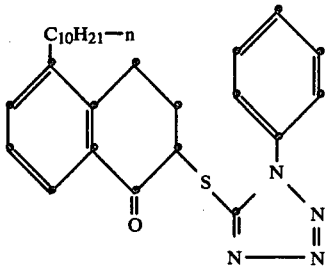
46
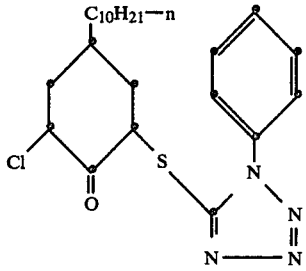
47
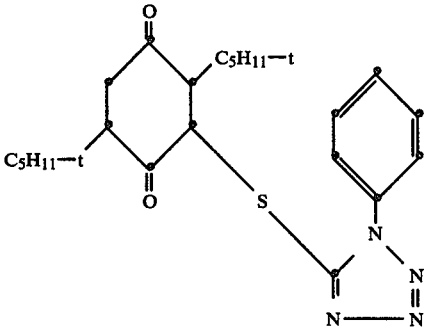
48
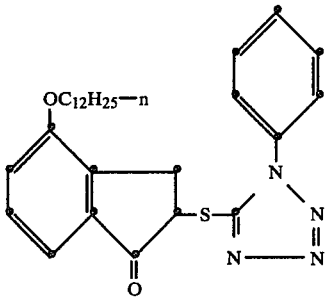

-continued
49
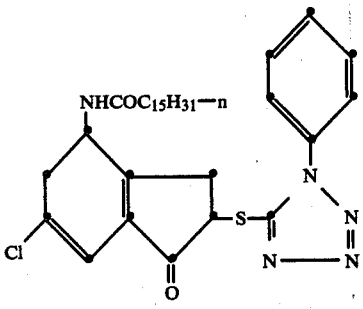
50
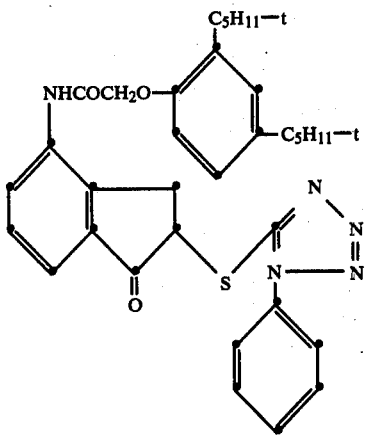
51
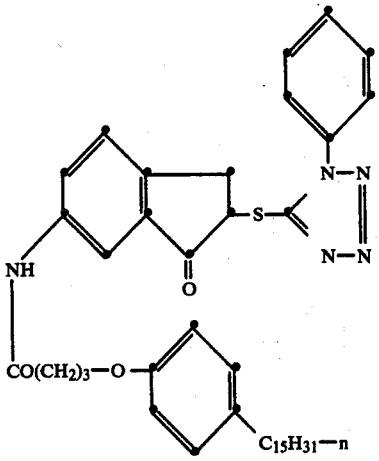
52
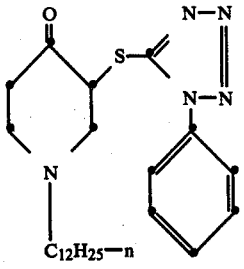
53
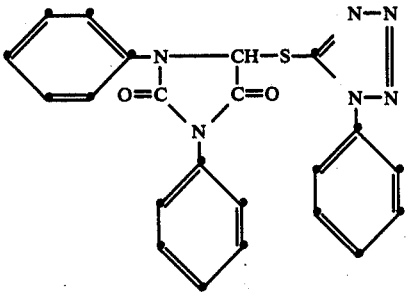
54
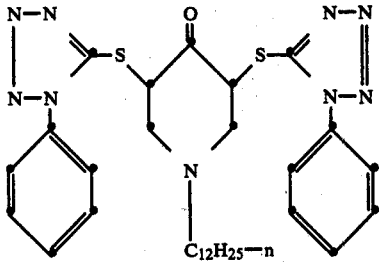
55
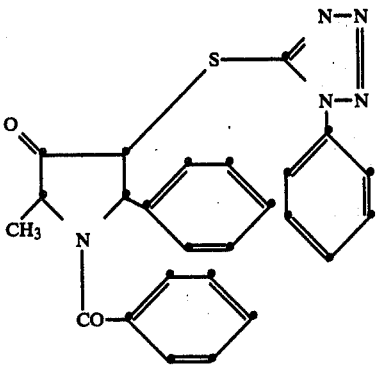
56
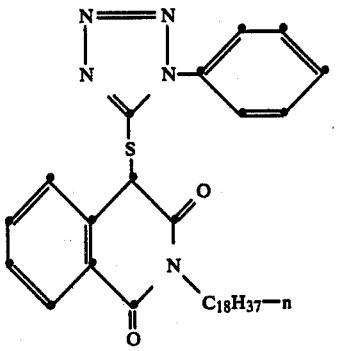

-continued
57
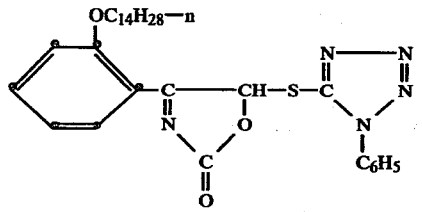
58
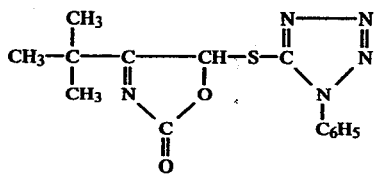
59
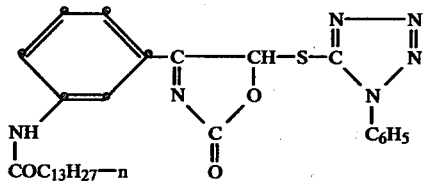
60
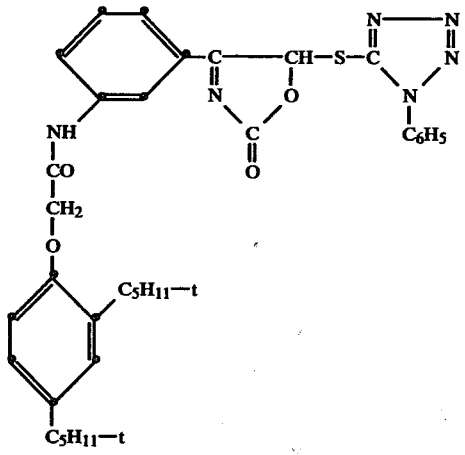
61
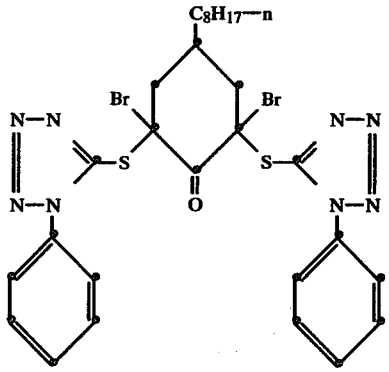
62
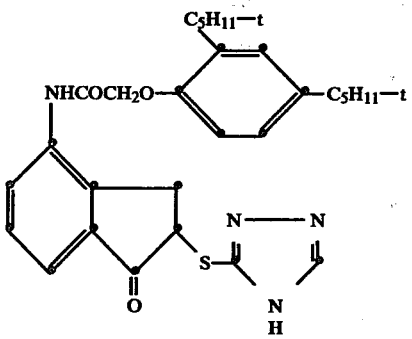
63
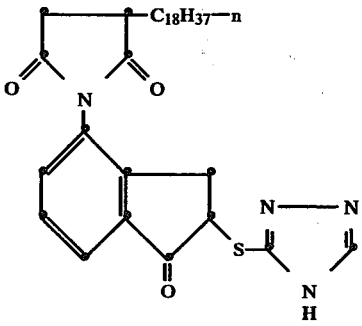
64
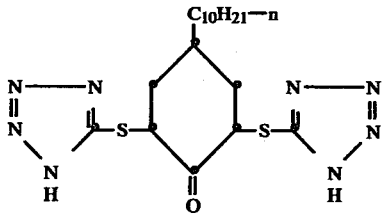
65
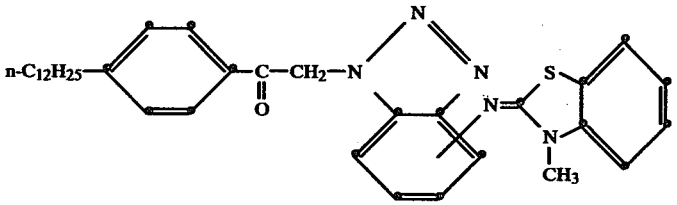

-continued
66
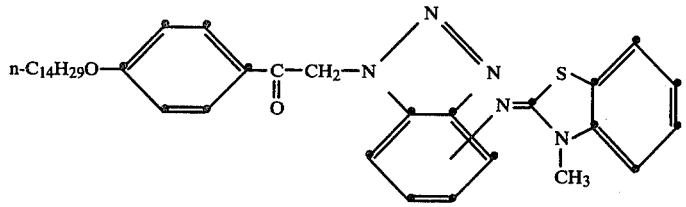
67
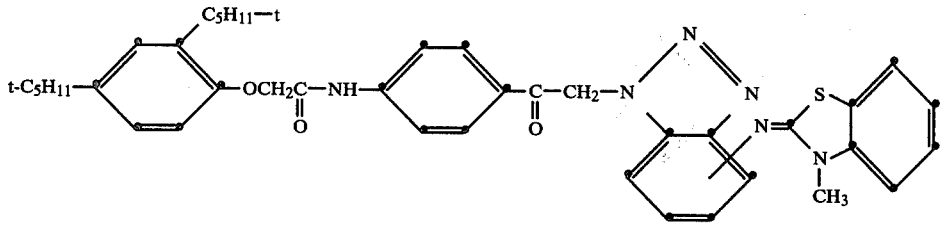
68
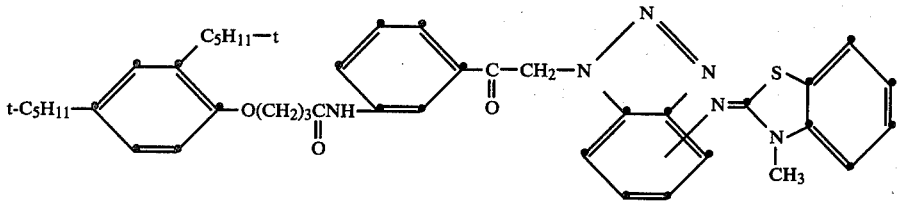
69
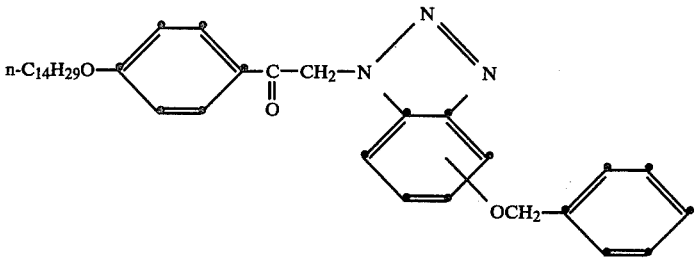
70
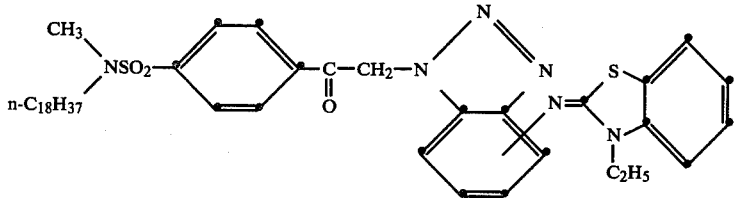
71
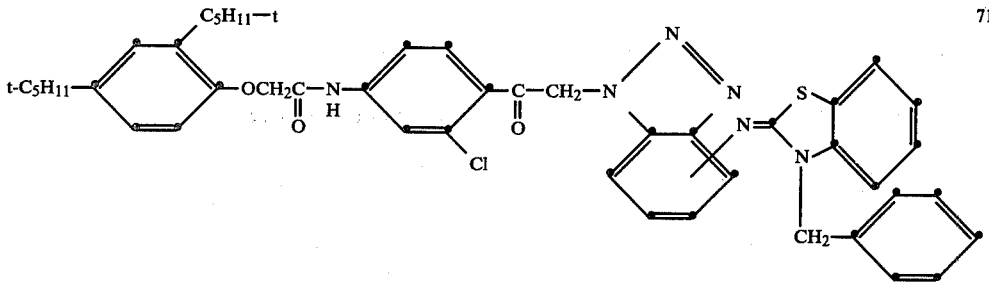

-continued
72
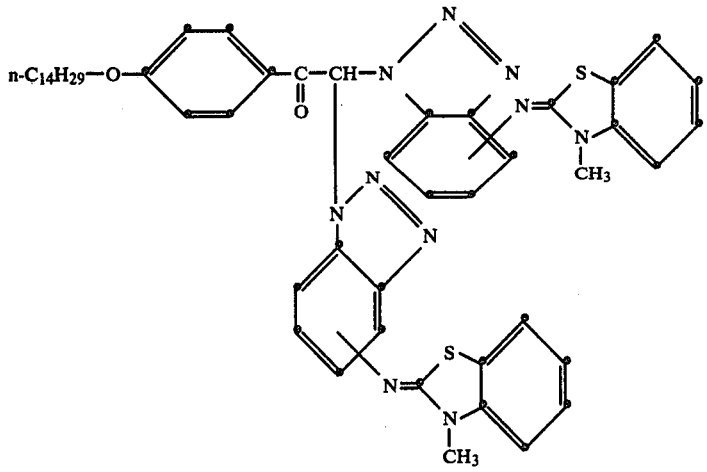
73
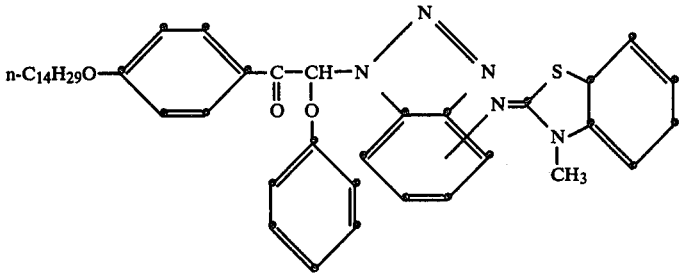
74
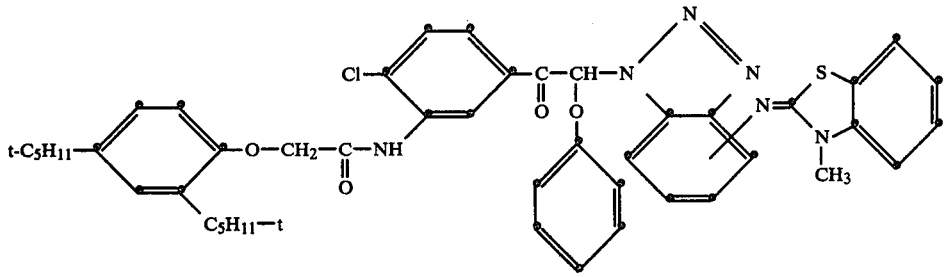
75
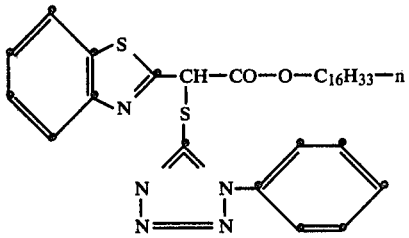
76
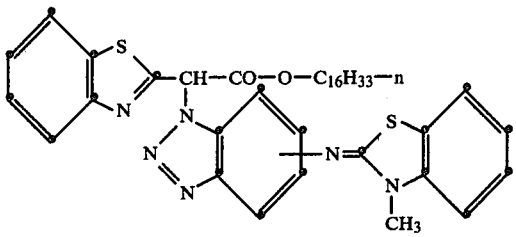
77
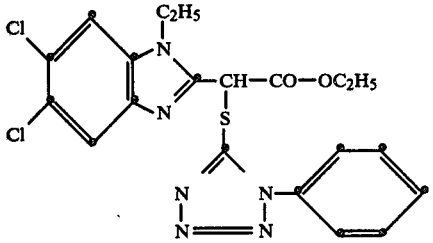
78
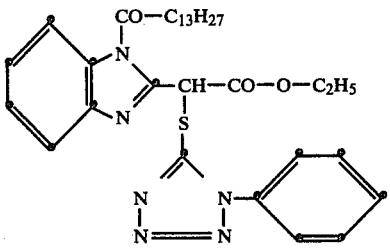

-continued

79

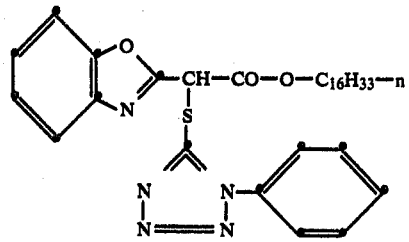

80

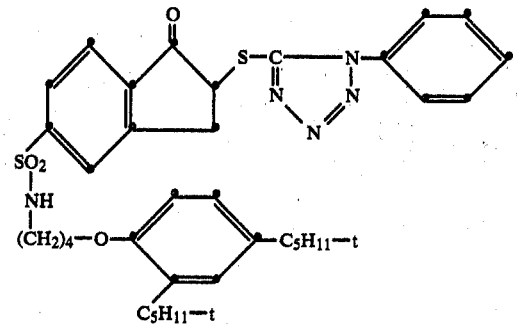

The photographic reagent releasing compounds employed in this invention are known compounds and can be prepared by procedures described in the patents and applications identified above relating to DIR compounds.

The 3-pyrazolidone developing agent employed in accordance with this invention can be any 3-pyrazolidone developing agent known in the art, it being appreciated that in its oxidized form the particular 3-pyrazolidone employed must be capable of oxidizing the particular PRR compound employed. Useful 3-pyrazolidone developing agents include: 1-phenyl-3-pyrazolidone, 1-phenyl-4,4-dimethyl-3-pyrazolidone, 4-hydroxymethyl-4-methyl-1-(3,4-dimethylphenyl)-3-pyrazolidone, 1-m-tolyl-3-pyrazolidone, 1-p-tolyl-3-pyrazolidone, 4-hydroxymethyl-4-methyl-1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone and the like.

The 3-pyrazolidone developing agent can be the sole developing agent employed in the process or contained in the assemblage or there can be more than one 3-pyrazolidone developing agent. In addition, in some circumstances it may be desirable to employ an auxiliary black and white developing agent, such as a hydroquinone, in combination with the 3-pyrazolidone developing agent.

To take maximum advantage of this invention the assemblage should be free of, and the process should be practiced in the absence of, a chromogenic or color developing agent. Color developing agents are understood in the art to be compounds which will react with and be oxidized by developable silver halide and which, in their oxidized form, will couple with the dye-forming couplers to form a dye. They include paraphenylenediamines and para-aminophenols. In some embodiments of this invention the film unit may contain a compound which is structurally similar to a color developing agent but which, as incorporated in the film unit, serves a different function, e.g., compounds which are scavengers for oxidized developing agent.

In practicing the process of the present invention the photographic reagent releasing compound is caused to react with oxidized 3-pyrazolidone developing agent under alkaline conditions, preferably at a pH of 13 to 14. An alkaline environment can be provided by a processing composition comprising an aqueous alkaline solution of a base, such as an alkali metal hydroxide or carbonate, e.g. sodium hydroxide or sodium carbonate or an amine, e.g., diethylamine.

Either or both of the photographic reagent releasing compound and the 3-pyrazolidone developing agent can be contained either in the alkaline processing solution or in a photographic element to be processed. If the photographic reagent releasing compound is contained in the alkaline processing composition, it should be a compound which is capable of migrating through the alkali-permeable layers of photographic elements. If the 3-pyrazolidone developing agent is contained in a photographic element it should be in a location where it will come into reactive association with developable silver halide when an alkali environment is provided. If the photographic reagent releasing compound is contained in a photographic element, it should be in a location where it will come into reactive association with oxidized 3-pyrazolidone developing agent when an alkaline environment is provided. When the photographic reagent releasing compound is contained in the photographic element, it preferably is of sufficient bulk so as to be substantially immobile in the alkali-permeable layers of the element.

Any means known in the photographic art for providing oxidized 3-pyrazolidone developing agent can be employed in the process of the present invention. A convenient means is to cause the 3-pyrazolidone developing agent to react with developable silver halide under alkaline conditions. The silver halide can be of any convenient conventional type, such as disclosed, for example, in Research Disclosure, Item 17643, Section I, December 1978. (Research Disclosure is published by Industrial Opportunities Ltd., Homewell Havant Hampshire, PO9 1EF United Kingdom.) The silver halide can be either negative-working or positive-working and can form either a surface or internal latent image upon exposure.

As described in the above referenced Research Disclosure Item 17643, silver halide emulsions can be chemically sensitized (Section III), be spectrally sensitized or desensitized (Section IV), be hardened (Section X), include stabilizers and antifoggants (Section VI), and contain other conventional photographic addenda.

Reaction of the photographic reagent releasing compound with oxidized 3-pyrazolidone developing agent makes available an imagewise pattern of photographic reagent as a direct function of a silver halide development. This pattern can be used in any of the ways known to those skilled in the art for making use of a photographic reagent in photographic elements and assemblages. For example, if the reagent is a development inhibitor, it can be used to suppress development of silver halide. If the photographic reagent is a bleach inhibitor, it can be used to inhibit bleaching of silver halide during a subsequent processing step. If the photographic reagent is a silver halide solvent or complexing agent, it can be used to enhance removal of silver halide from the element or film unit during a subsequent processing step or to assist migration of silver halide in the element or film unit. If the photographic reagent is an auxiliary developing agent it can be used to assist development of silver halide. If the photographic reagent is a spectral sensitizing dye it can be used to render silver halide differentially sensitive to exposure to electromagnetic radiation which occurs contemporaneous with or subsequent to release of the reagent. Still other ways in which the released photographic reagent can be employed in photographic elements, assemblages and processes will be apparent to those skilled in the art.

It is expected that the present invention will find maximum utility in color diffusion transfer film units which are not based on coupler chemistry. With such materials the present invention provides a convenient means for releasing a development inhibitor or other photographic reagent while avoiding the need for an auxiliary color developing agent. Accordingly, the remainder of this discussion will be directed towards color diffusion transfer assemblages of the invention.

The silver halide emulsion or emulsions can be any of the emulsions described above. The assemblages can be designed to yield single color or multicolor images. In film units designed to provide multicolor images the silver halide emulsions are arranged in units each sensitive to a different one of the three primary regions of the visible spectrum and have associated therewith a dye image providing material that provides an image dye which absorbs radiation in one of the three primary regions of the visible spectrum. Each unit can be comprised of a single emulsion layer or of multiple emulsion layers sensitive to a given region of the spectrum. The various layers, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. patent application No. 8,819 filed Feb. 2, 1979.

Depending upon the dye image providing material employed, it can be incorporated in the silver halide emulsion layer or in a separate layer associated with the emulsion layer. Similarly, the photographic reagent releasing compound and the 3-pyrazolidone developing agent can be incorporated in the silver halide emulsion layer, in a layer associated therewith, or, as indicated above, these latter components can be incorporated in the alkaline processing composition used to develop the film unit.

The dye image providing material can be any of a number known in the art. Useful materials contain a dye moiety and a monitoring moiety. The monitoring moiety, in the presence of an alkaline processing solution and as a function of silver halide development, is responsible for a change in mobility of the dye moiety. Dye image providing materials can be initially mobile, and rendered immobile as a function of silver halide development, as described in U.S. Pat. No. 2,983,606. Alternatively, dye image providing materials can be initially immobile and rendered mobile, in the presence of an alkaline processing solution, as a function of silver halide development. This latter class of materials are referred to as redox dye releasing compounds. In such compounds, the monitoring group is a carrier from which the dye is released as a direct function of silver halide development or an an inverse function of silver halide development. Compounds which release dye as an inverse function of silver halide development are referred to as negative-working release compounds while compounds which release dye as an inverse function of silver halide development are referred to as positive-working release compounds.

A preferred class of negative-working release compounds are the ortho or para sulfonamidophenols and naphthols described in U.S. Pat. Nos. 4,054,312, 4,055,428 and 4,076,529. In these compounds the dye moiety is attached to a sulfonamido group which is ortho or para to the phenolic hydroxy group and is released by hydrolysis after oxidation of the sulfonamido compound during development.

A preferred class of positive-working release compounds are the nitrobenzene and quinone compounds described in U.S. Patent No. 4,139,379. In these compounds the dye moiety is attached to an electrophilic cleavage group, such as a carbamate group, ortho to the nitro group or the quinone oxygen, and is released upon reduction of the compound by an electron donor compound contained in the element or the processing composition, unless the electron donor is oxidized during development.

Other useful positive-working release compounds are the hydroquinones described in U.S. Pat. No. 3,980,479 and the benzisoxazolone compounds described in U.S. Pat. No. 4,199,354.

Further details regarding the above release compounds, the manner in which they function, and the procedures by which they can be prepared are contained in the patents referred to above, the disclosures of which are incorporated herein by reference.

In addition to the layers referred to above, the elements and assemblages can contain additional layers conventional in photographic elements and film units, such as spacer layers, filter layers, antihalation layers, scavenger layers, pH lowering layers (sometimes referred to as acid layers and neutralizing layers), timing layers, opaque light-reflecting layers, opaque light-absorbing layers, and the like. Useful supports include polymeric films, paper (including polymer-coated paper), glass and the like.

To obtain a dye image with assemblages of the present invention, an alkaline environment is provided to permit the development of developable silver halide and consequent release of photographic reagent and change in mobility of the dye image providing material. This results in an imagewise pattern of photographic reagent as a direct function of silver halide development and an imagewise pattern of diffusible dye either as a direct or an inverse function of silver halide development.

The diffusible dye can be transferred to an image receiving layer and employed as a transfer image. Alternatively, it can merely be removed from the assemblage. Whether the diffusible dye is employed to form a transfer image or not, the remaining dye image providing material, from which dye has not been released, can be employed to form either a retained image or a transfer image by techniques well known to those skilled in the art.

The effect which the imagewise pattern of released photographic reagent will have on image formation will depend upon (1) the photographic reagent released, (2) the type of silver halide employed and (3) the type of dye image providing material employed.

The alkaline processing composition can be an aqueous alkaline solution as described above. It can be a component of the assemblage and introduced into reactive association with other components of the film unit from a rupturable container which is adapted to be positioned during processing of the assemblage so that a compressive force applied to the container by pressure-applying members will rupture the container and effect a discharge of the containers contents within the assemblage. Preferred rupturable containers are described in U.S. Pat. Nos. 2,543,181; 2,643,886; 2,653,732; 2,723,051; 3,056,492; 3,056,491 and 3,152,515. However, other methods of introducing the alkaline processing composition can be employed.

The dye image receiving layer can be on a separate support which is brought into contact with the emulsion layer(s) during or subsequent to processing. However, it preferably forms an integral part of the assemblage.

Any material can be employed as the image receiving layer in the assemblages of this invention as long as it will mordant, or otherwise fix, the dye which diffuses to it. The particular material chosen will, of course, depend upon the dyes to be mordanted. The image receiving layer can contain ultraviolet absorbers to protect the dye images from fading due to ultraviolet light, brighteners and similar materials to protect or enhance photographic dye images, and the like.

Various formats for diffusion transfer assemblages are known in the art. The layer arrangement employed with them can be used in the assemblages of this invention. In one useful format, the dye image receiving layer is located on a separate support adapted to be superposed on the photographic element after exposure thereof. Such image receiving layers are generally disclosed, for example, in U.S. Pat. No. 3,362,819.

In another useful format, the dye image receiving layer is located integral with the photographic element and is positioned between the support and the lowermost silver halide emulsion layer. One such format is disclosed in Belgian Pat. No. 757,960. In such a format, the support for the photographic element is transparent and bears in order, an image receiving layer, a substantially opaque light-reflective layer, and then the photosensitive layer or layers. After imagewise exposure, a rupturable container containing the alkaline processing composition and an opaque process sheet are brought into superposed position position. Pressure-applying members in the camera rupture the container and spread processing composition over the photographic element as the assemblage is withdrawn from the camera. The processing composition develops each exposed silver halide emulsion layer and dye images, formed as a function of development, diffuse to the image receiving layer to provide a right-reading image which is viewed through the transparent support on the opaque reflecting layer backgrounds. For other details concerning the format of this particular integral film unit, reference is made to the above-mentioned Belgian Pat. No. 757,960.

Another format is disclosed in Belgian Pat. No. 757,959. In this embodiment, the support for the photographic element is transparent and bears, in order, the image receiving layer, a substantially opaque, light-reflective layer and the photosensitive layer or layers. A rupturable container, containing an alkaline processing composition and an opacifier, is positioned between the uppermost emulsion layer and a transparent top sheet which has thereon a neutralizing layer and a timing layer. The assemblage is placed in a camera, exposed through the transparent top sheet and then passed through a pair of pressure-applying members in the camera as it is being removed therefrom. The pressure-applying members rupture the container and spread processing composition and opacifier over the photographic layers to commence development and protect the photosensitive layers from further light exposure. The processing composition develops each silver halide layer and dye images, formed as a result of development, diffuse to the image receiving layer to provide a right-reading image which is viewed through the transparent support on the opaque reflecting layer background. For further details concerning the format of this particular integral assemblage, reference is made to the above-mentioned Belgian Pat. No. 757,959.

Still other useful formats in which this invention can be employed are described in U.S. Pat. Nos. 3,415,644; 3,415,645; 3,415,646; 3,647,437; 3,635,707; and 3,993,486.

The term "nondiffusible" used herein has the meaning commonly applied to the term in photography and denotes materials that for all practical purposes do not migrate nor wander through organic colloid layers such as gelatin in an alkaline medium, in photographic elements and preferably when processed in a medium having a pH of 11 or greater. The same meaning is to be attached to the term "immobile." The term "diffusible" has the converse meaning and denotes the materials having the property of diffusing effectively through the colloid layers of photographic elements in an alkaline medium. "Mobile" has the same meaning.

The term "associated therewith" as used herein is intended to mean that the materials can be in either the same or different layers so long as the materials are accessible to one another during processing.

The following examples illustrate the release of development inhibitor as a direct function of silver halide development with a 3-pyrazolidone developing agent. The photographic elements employed are image transfer materials designed to provide a retained image. They contain negative-working silver halide and a redox dye releaser which releases a diffusible dye as a direct function of silver halide development. During processing released dye diffuses out of the element into the processing solution leaving in the element an imagewise distribution of redox dye releaser which is either initially colored or converted to its colored form during processing. Thus, there is retained in the element, as an inverse function of silver halide development, colored redox dye releaser which provides the final image.

The specific control elements employed in the examples have a relatively high contrast and consequently a relatively short exposure latitude. By providing imagewise release of development inhibitor as a direct function of silver halide development, development is inhibited to a greater extent in high exposure areas than in low exposure areas. This results in a lowering of contrast and a consequent extension of exposure latitude. In the following examples, in which the control and inventive elements were processed to yield essentially the same minimum and maximum densities, an extension of exposure latitude in the inventive element, compared with the control element, illustrates the imagewise release of development inhibition by oxidized 3-pyrazolidone developing agent and one of the advantageous effects obtained thereby.

EXAMPLE 1

A color photographic element having the following schematic structure (A) was prepared. The numerical values denote quantities in (g/m$^2$).

| |
|---|
| Gelatin - 1.08 |
| Red-sensitive silver halide, as silver - 1.08 / redox dye releaser (see below) - 1.13 in diethyllauramide - 0.57 / gelatin - 2.16 |
| Poly(ethylene terephthalate) Film Support |

A second color photographic element (B) was prepared which differed only in that it also contained 0.09 g/m$^2$ (14 millimoles/mole Ag) of PRR compound No. 1 dispersed in 0.05 g/m$^2$ of diethyllauramide.

The redox dye releaser in these elements had the structure:

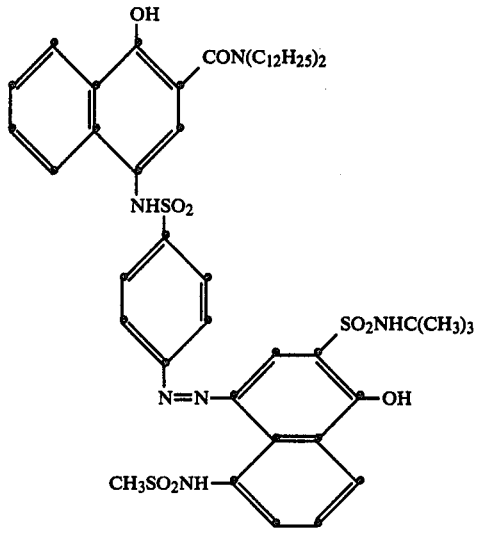

A sample of each element was sensitometrically exposed for 0.1 second through a 0–6 graduated neutral density test object, developed for 60 seconds in a developer solution having the following composition:

28 g Potassium Hydroxide
2.0 g Potassium Sulfite
7.5 g Potassium Bromide
0.1 g 5-Methylbenzotriazole
1.0 g 4-Hydroxymethyl-4-Methyl-1-Phenyl-3-Pyrazolidone
2.0 g 11-Aminoundecanoic Acid
Water to 1 liter, pH 13.46 then fixed, washed, buffered to pH 10 and dried. There was obtained in each element a negative silver image and a positive dye image of the test object. The coverage of silver, as a function of exposure, was measured by X-ray fluorescence analysis and silver vs. log exposure curves were generated for the negative silver images. The results are reported in Table I below.

A second sample of each element was exposed and processed as described above, except that the elements were bleach-fixed to remove all silver. Positive dye images of the test object were obtained from which density vs. log exposure curves were generated. The results are reported in Table I below.

TABLE I

| | Silver Image | | | Dye Image | | |
|---|---|---|---|---|---|---|
| Element | $Ag_{min}$ (g/m$^2$) | $Ag_{max}$ (g/m$^2$) | Exposure Latitude[1] | $D_{min}$ | $D_{max}$ | Exposure Latitude[2] |
| A(control) | 0 | 0.26 | 0.38 | 0.1 | 3.2 | 0.49 |
| B(invention) | 0 | 0.26 | 0.62 | 0.1 | 3.3 | 0.72 |

[1]Reported as the difference in log E between the points on the curves which correspond to 10 percent and 90 percent of $Ag_{max}$.
[2]Reported as the difference in log E between the points on the curves which correspond to 0.2 density units above $D_{min}$ and 0.2 density units below $D_{max}$.

This data shows a significant extension of exposure latitude as a result of imagewise release of development inhibitor by oxidized 3-pyrazolidone developing agent.

EXAMPLE 2

Four photographic elements were prepared having the following common schematic structure. The numerical values denote quantities in g/m$^2$.

| |
|---|
| Didodecylhydroquinone (oxidized developing agent scavenger) - 0.43 / Gelatin - 1.03 |
| Fast green-sensitive silver bromoiodide, as silver - 0.65 / Gelatin - 1.36 / Redox dye releaser (see below) - 0.76 / PRR Compound (see below) - 0.79 millimoles/m$^2$ (13 millimoles/mole Ag) |
| Slow green-sensitive silver bromoiodide, as silver - 0.65 / Gelatin - 1.36 / Redox dye releaser (see below) - 0.76 / PRR Compound (see below) - 0.079 millimoles/m$^2$ (13 millimoles/mole Ag) |
| Gelatin - 1.03 |
| Didodecylhydroquinone (oxidized developing agent scavenger) - 0.43 / Gelatin - 1.03 |
| Gray silver antihalation layer - 0.27 / Gelatin - 1.03 |
| ////////////// Film Support ////////////// |

The redox dye releaser in each of the elements has the structure:

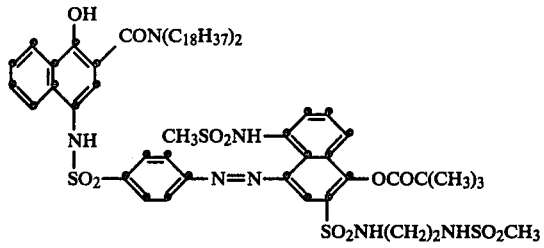

A sample of each element was exposed for 1/50 second through a 0–3 neutral graduated-density test object and a Wratten 99 filter.

The exposed elements were developed for the time indicated in Table II, below, with a developer solution having the following composition:

38.8 g Trisodium phosphate
2.5 g Potassium bromide
1.0 g Sodium sulfite 2.0 g 11-Aminoundecanoic acid 0.5 g 4-Hydroxymethyl-4-methyl-1-phenyl-3-pyrazolidone Water to 1 liter pH adjusted to 13.0 with 50% sodium hydroxide.

The elements were then washed, bleach-fixed, washed, stabilized and dried. A positive dye image was obtained in each element from which density vs. log exposure curves were generated. The results are reported in Table II, below.

TABLE II

| Element | Time (sec) | PRR Compound No. | $D_{min}$ | $D_{max}$ | Exposure Latitude[2] |
|---|---|---|---|---|---|
| C (Control) | 60 | None | 0.2 | 3.0 | 1.05 |
| D | 100 | 1 | 0.2 | 3.2 | 1.30 |
| E | 80 | 4 | 0.2 | 3.2 | 1.18 |
| F | 100 | 19 | 0.2 | 3.3 | 1.59 |

[2]Reported as the difference in log E between the points on the curves which correspond to 0.2 density units above $D_{min}$ and 0.2 density units below $D_{max}$.

This data shows that each of the compounds tested provides an extension of exposure latitude as a result of imagewise release of development inhibitor by oxidized 3-pyrazolidone developing agent.

This invention has been described in detail with particular reference to certain preferred embodiments thereof but it will be understood that variations and modifications can be effected within the spirit and scope of the invention.

What is claimed is:

1. A photographic assemblage for producing a dye image wherein an imagewise pattern of diffusible dye and an imagewise pattern of photographic reagent are formed by means of an oxidized 3-pyrazolidone developing agent, the assemblage comprising (a) a support bearing at least one silver halide emulsion layer having associated therewith a dye image-providing material which is capable of providing an imagewise pattern of diffusible dye as a function of silver halide development;

(b) a photographic reagent releasing compound comprising an acyclic or cyclic compound in which the photographic reagent is linked, through a hetero atom, to a carbon atom which is adjacent to or in conjugation with a carbonyl group or an imino group;

(c) a dye image receiving layer;

(d) an alkaline processing composition and means for discharging same within the assemblage; and (e) a 3-pyrazolidone developing agent which in its oxidized form is capable of oxidizing, under alkaline conditions, the photographic reagent releasing compound to cleave the hetero atom from the carbon atom to which it is linked and thereby release the photographic reagent;

the assemblage being free of color developing agent.

2. An assemblage of claim 1 wherein the 3-pyrazolidone developing agent is contained within the alkaline processing composition.

3. An assemblage of claim 1 wherein the photographic reagent releasing compound has one of the following structures:

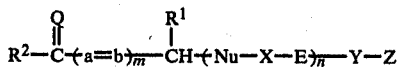

-continued and

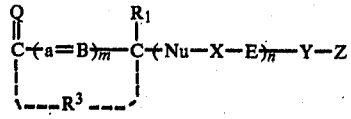

wherein:

Q is =O or =$NR^4$ where $R^4$ is hydroxy or amino;

Y is —S—, —O— or

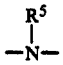

where $R^5$ is hydrogen, alkyl, aryl or a covalent bond in a heterocyclic ring formed by Y and Z;

Z represents the atoms which, together with Y, form a photographic reagent;

m is 0 or 1;

n is 0 or 1;

one of a and b is

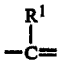

and the other is

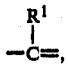

or —N=;

Nu—X—E is a timing group which, upon displacement from the carbon atom to which it is attached, undergoes an intramolecular nucleophilic displacement reaction to release Y—Z, where Nu is a nucleophilic group, E is an electrophilic group and X is a linking group for spatially relating Nu and E, upon displacement from the carbon atom, to undergo an intramolecular nucleophilic displacement reaction;

$R^1$ is hydrogen, halogen, alkyl, aryl, heterocyclyl, —(Nu—X—E)$_n$— Y—Z or O—$R^6$ where $R^6$ is alkyl, aryl, heterocyclyl,

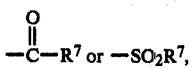

where $R^7$ is alkyl, aryl or heterocyclyl;

$R^2$ is alkyl, aryl, heterocyclyl, cyano, —$N(R^8)_2$, —$SO_2R^8$, —$SO_2OR^8$, —$SO_2N(R^8)_2$, —$N^+(R^8)_3$ or $OR^8$ where $R^8$ is hydrogen, alkyl, aryl or heterocyclyl, or two $R^8$ groups combined with a nitrogen atom to which they are attached form a heterocyclic nitrogen ring; and $R^3$ represents the atoms to complete a saturated or unsaturated, carbocyclic or heterocyclic ring or ring system containing at least one 5- or 7-membered ring.

4. An assemblage of claim 1 wherein the photographic reagent releasing compound has one of the following structures:

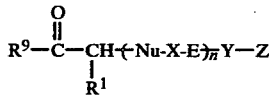

and

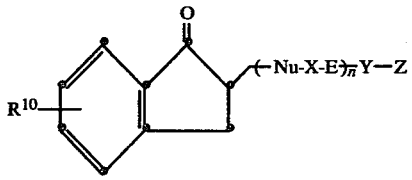

wherein:

Y is

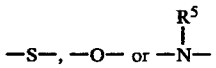

where $R^5$ is hydrogen, alkyl, aryl or a covalent bond in a heterocyclic ring formed by Y and Z;

Z represents the atoms which, together with Y, form a photographic reagent;

n is 0 or 1;

Nu—X—E is a timing group, which upon displacement from the carbon atom to which it is attached, undergoes an intramolecular nucleophilic displacement reaction to release Y—Z, where Nu is a nucleophilic group, E is an electrophilic group and X is a linking group for spatially relating Nu and E, upon displacement from the carbon atom, to undergo an intramolecular nucleophilic displacement reaction;

$R^1$ is hydrogen, halogen, alkyl, aryl, heterocyclyl, $-(Nu-X-E)_n-$ Y—Z or $OR^6$ where $R^6$ is alkyl, aryl, heterocyclyl,

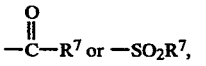

where $R^7$ is alkyl, aryl or heterocyclyl;

$R^9$ is alkyl, aryl or heterocyclyl and $R^{10}$ is $R^9$, $(R^{11})_2NSO_2-$, $R^{11}SO_2NR^{11}-$, $(R^{11})_2NCO-$, or $R^{11}CONR^{11}-$ where $R^{11}$ is hydrogen, alkyl, aryl or heterocyclyl.

5. An assemblage of claim 3 wherein the group Y—Z forms a development inhibitor.

6. An assemblage of claim 4 wherein:

n is 0;

Y—Z is a development inhibitor;

$R^1$ is hydrogen;

$R^9$ is aryl; and $R^{10}$ is $(R^{11})_2NSO_2-$, $R^{11}SO_2NR^{11}-$, $(R^{11})_2NCO-$, or $R^{11}CONR^{11}-$.

7. An assemblage of any one of claims 3, 4, 5 or 6 wherein the 3-pyrazolidone developing agent is selected from the group consisting of 4-hydroxymethyl-4-methyl-1-phenyl-3-pyrazolidone, 4-hydroxymethyl-4-methyl-1-(3,4-diphenyl-3-pyrazolidone, 4-hydroxymethyl-4-methyl-1-(3,4-dimethylphenyl)-3-pyrazolidone, and 4-hydroxymethyl-4-methyl-1-p-tolyl-3-pyrazolidone.

8. An assemblage of claim 1 wherein the silver halide emulsion is a direct positive emulsion and the dye image providing material releases a diffusible dye as a direct function of silver halide development.

9. An assemblage of claim 8 wherein the dye-image providing material is a sulfonamido dye releaser.

10. An assemblage of claim 1 wherein the silver halide emulsion is a negative-working emulsion and the dye image providing material releases a mobile dye as an inverse function of silver halide development.

11. An assemblage of claim 10 wherein the dye image providing material is a quinone dye releaser or nitro dye releaser and the film unit further contains an electron donor associated with the dye releaser.

12. A process of releasing a photographic reagent from a photographic reagent releasing compound comprising an acyclic or cyclic compound in which the photographic reagent is linked, through a hetero atom, to a carbon atom which is adjacent to or in conjugation with a carbonyl group or an imino group, the process comprising the step of causing the photographic reagent releasing compound to react, under alkaline conditions, with oxidized 3-pyrazolidone developing agent to cleave the hetero atom from the carbon atom to which it is linked and thereby release the photographic reagent.

13. A process of claim 12 wherein the photographic reagent releasing compound has one of the following structures:

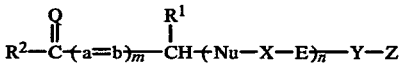

and

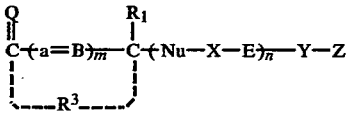

wherein:

Q is =O or $=NR^4$ where $R^4$ is hydroxy or amino;

Y is

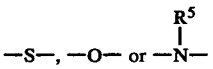

where $R^5$ is hydrogen, alkyl, aryl or a covalent bond in a heterocyclic ring formed by Y and Z;

Z represents the atoms which, together with Y, form a photographic reagent;

m is 0 or 1;

n is 0 or 1;

one of a and b is

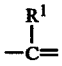

and the other is $$-\overset{R^1}{\overset{|}{C}}=,$$

or —N=;

Nu—X—E is a timing group which, upon displacement from the carbon atom to which it is attached, undergoes an intramolecular nucleophilic displacement reaction to release Y—Z, where Nu is a nucleophilic group, E is an electrophilic group and X is a linking group for spatially relating Nu and E, upon displacement from the carbon atom, to undergo an intramolecular nucleophilic displacement reaction;

$R^1$ is hydrogen, halogen, alkyl, aryl, heterocyclyl, $-(Nu-X-E)_n-$ Y—Z or O—$R^6$ where $R^6$ is alkyl, aryl, heterocyclyl, $$-\overset{O}{\overset{\|}{C}}-R^7 \text{ or } -SO_2R^7,$$

where $R^7$ is alkyl, aryl or heterocyclyl;

$R^2$ is alkyl, aryl, heterocyclyl, cyano, $-N(R^8)_2$, $-SO_2R^8$, $-SO_2OR^8$, $-SO_2N(R^8)_2$, $-N^+(R^8)_3$ or $OR^8$ where $R^8$ is hydrogen, alkyl, aryl or heterocyclyl, or two $R^8$ groups combined with a nitrogen atom to which they are attached form a heterocyclic nitrogen ring; and $R^3$ represents the atoms to complete a saturated or unsaturated, carbocyclic or heterocyclic ring or ring system containing at least one 5- to 7-membered ring.

14. A process of claim 12 wherein the photographic reagent releasing compound has one of the following structures:

$$R^9-\overset{O}{\overset{\|}{C}}-\underset{R^1}{\underset{|}{CH}}-(Nu\text{-}X\text{-}E)_n-Y-Z$$

and

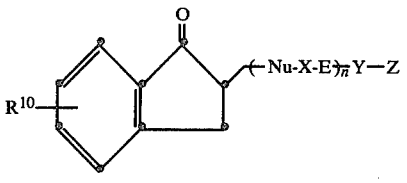

wherein:

Y is $$-S-, -O- \text{ or } -\overset{R^5}{\overset{|}{N}}-$$

where $R^5$ is hydrogen, alkyl, aryl or a covalent bond in a heterocyclic ring formed by Y and Z;

Z represents the atoms which, together with Y, form a photographic reagent;

n is 0 or 1;

Nu—X—E is a timing group which, upon displacement from the carbon atom to which it is attached, undergoes an intramolecular nucleophilic displacement reaction to release Y—Z, where Nu is a nucleophilic group, E is an electrophilic group and X is a linking group for spatially relating Nu and E, upon displacement from the carbon atom, to undergo an intramolecular nucleophilic displacement reaction;

$R^1$ is hydrogen, halogen, alkyl, aryl, heterocyclyl, $-(Nu-X-E)_n-$ Y—Z or O—$R^6$ where $R^6$ is alkyl, aryl, heterocyclyl, $$-\overset{O}{\overset{\|}{C}}-R^7 \text{ or } -SO_2R^7,$$

where $R^7$ is alkyl, aryl or heterocyclyl;

$R^9$ is alkyl, aryl or heterocyclyl and $R^{10}$ is $R^9$, $(R^{11})_2NSO_2-$, $R^{11}SO_2NR^{11}-$, $(R^{11})_2NCO-$, or $R^{11}CONR^{11}-$ where $R^{11}$ is hydrogen, alkyl, aryl or heterocyclyl.

15. A process of claim 13 wherein the group Y—Z forms a development inhibitor.

16. A process of claim 14 wherein:

n is 0;

Y—Z is a development inhibitor;

$R^1$ is hydrogen;

$R^9$ is aryl; and $R^{10}$ is $(R^{11})_2NSO_2-$, $R^{11}SO_2NR^{11}-$, $(R^{11})_2NCO-$.

17. A process of any one of claims 12, 13, 14, 15 or 16 wherein oxidized 3-pyrazolidone developing agent is generated by silver halide development.

18. A process of claim 17 wherein the 3-pyrazolidone developing agent is selected from the group consisting of 4-hydroxymethyl-4-methyl-1-phenyl-3-pyrazolidone, 4-hydroxymethyl-4-methyl-1-(3,4-dimethylphenyl)-3-pyrazolidone, and 4-hydroxymethyl-4-methyl-1-p-tolyl-3-pyrazolidone.

19. A process of claim 17 further comprising, concurrent with the release of photographic reagent, forming an imagewise pattern of diffusible dye as a function of silver halide development.

20. A process of claim 19 wherein the imagewise pattern of diffusible dye is formed as a direct function of silver halide development.

21. A process of claim 19 wherein the imagewise pattern of diffusible dye is formed in an inverse function of silver halide development.

* * * * *